US009368087B2

(12) United States Patent
Ninan et al.

(10) Patent No.: US 9,368,087 B2
(45) Date of Patent: Jun. 14, 2016

(54) DISPLAY BACKLIGHT NORMALIZATION

(75) Inventors: Ajit Ninan, San Jose, CA (US); Wenhui Jia, Dublin, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 112 days.

(21) Appl. No.: 13/814,584

(22) PCT Filed: Aug. 25, 2011

(86) PCT No.: PCT/US2011/049127
§ 371 (c)(1),
(2), (4) Date: Feb. 6, 2013

(87) PCT Pub. No.: WO2012/030620
PCT Pub. Date: Mar. 8, 2012

(65) Prior Publication Data

US 2013/0286037 A1 Oct. 31, 2013

Related U.S. Application Data

(60) Provisional application No. 61/379,391, filed on Sep. 2, 2010, provisional application No. 61/378,774, filed on Aug. 31, 2010, provisional application No. 61/378,752, filed on Aug. 31, 2010.

(51) Int. Cl.
*G09G 5/02* (2006.01)
*G09G 5/10* (2006.01)
*G09G 5/34* (2006.01)

(52) U.S. Cl.
CPC . *G09G 5/10* (2013.01); *G09G 5/346* (2013.01)

(58) Field of Classification Search
CPC ..... G09G 5/02; G06T 11/001
USPC ..... 345/589; 13/589
See application file for complete search history.

(56) References Cited

U.S. PATENT DOCUMENTS

| | | | | |
|---|---|---|---|---|
| 2002/0051250 | A1 | 5/2002 | Agano | |
| 2004/0201561 | A1 | 10/2004 | Funamoto | |
| 2005/0035974 | A1 | 2/2005 | Nair | |
| 2007/0269104 | A1* | 11/2007 | Whitehead et al. | 382/162 |
| 2011/0122171 | A1* | 5/2011 | Kwon et al. | 345/690 |
| 2011/0141155 | A1* | 6/2011 | Hong et al. | 345/690 |

(Continued)

FOREIGN PATENT DOCUMENTS

| | | |
|---|---|---|
| CN | 101512516 | 8/2009 |
| EP | 1858001 | 11/2007 |

(Continued)

OTHER PUBLICATIONS

R. P. Kovaleski and M. M. Oliveira, High-quality brightness enhancement functions for real-time reverse tone mapping, Visual Computer, vol. 25, No. 5, pp. 539-547, 2009.*

(Continued)

*Primary Examiner* — Devona Faulk
*Assistant Examiner* — Jin Ge

(57) ABSTRACT

Techniques for displaying images of different dynamic ranges in a display system are provided. In some embodiments, images that have a number of dynamic ranges may be normalized to a configured dynamic range that corresponds to the full intensity reproduction capability of the device. The configured dynamic range may be wider, greater, or deeper than the relatively limited dynamic range.

15 Claims, 4 Drawing Sheets

(56) References Cited

U.S. PATENT DOCUMENTS

| | | | | |
|---|---|---|---|---|
| 2011/0188744 | A1* | 8/2011 | Sun | 382/162 |
| 2011/0316973 | A1* | 12/2011 | Miller et al. | 348/43 |
| 2012/0201456 | A1* | 8/2012 | El-Mahdy et al. | 382/167 |

FOREIGN PATENT DOCUMENTS

| | | |
|---|---|---|
| WO | 2008/145027 | 12/2008 |
| WO | 2009/015483 | 2/2009 |
| WO | 2010/045038 | 4/2010 |

OTHER PUBLICATIONS

Banterle F., Ledda P., Debattista K., Chalmers A.: Expanding low dynamic range videos for high dynamic range applications. In SCCG'08: Proceedings of the 4th Spring Conference on Computer Graphics (New York, NY, USA, 2008), ACM, pp. 349-356.*

Banterle, F., Debattista, K., Artusi, A., Pattanaik, S., Myszkowski, K., Ledda, P., Chalmers, A., and Bloj, M. 2009a. High dynamic range imaging and low dynamic range expansion for generating HDR content. Comput. Graph. Forum 28, 8, 2343-2367.*

Charles Poynton, "Brightness" and "Contrast" controls, Mar. 11, 2002, http://www.poynton.com/PDFs/Brightness_and_Contrast.pdf.*

J. Hong, S. Kim, and W. Song, "A Clipping Reduction Algorithm Using Backlight Luminance Compensation for Local Dimming Liquid Crystal Displays," IEEE Trans. Consumer Electron., vol. 56, No. 1, pp. 240-246, Feb. 2010.*

Rempel, A.G. et al. "Ldr2Hdr: On-the-fly Reverse Tone Mapping of Legacy Video and Photographs" ACM Transactions on Graphics, vol. 26, No. 3, Jul. 29, 2007.

* cited by examiner

DISPLAY BACKLIGHT NORMALIZATION

CROSS-REFERENCE TO RELATED APPLICATIONS

This application claims priority to U.S. Provisional Patent Application No. 61/378,752 filed 31 Aug. 2010; No. 61/378,774 filed 31 Aug. 2010 and No. 61/379,391 filed 2 Sep. 2010.

TECHNOLOGY

The present invention relates generally to display systems, and in particular, to high dynamic range display systems.

BACKGROUND

Some images may require the use of a high dynamic range (HDR) display system while some other images may require only a low dynamic range (LDR) display system. An HDR display system may be called upon to display both HDR images and LDR images. When displaying the HDR images, the HDR capability inhered in the display system may be fully expressed. However, when displaying the LDR images, the same HDR capability may be of little use. As a result, an HDR may look the same way as a LDR display system. The approaches described in this section are approaches that could be pursued, but not necessarily approaches that have been previously conceived or pursued. Therefore, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF DRAWINGS

The present invention is illustrated by way of example, and not by way of limitation, in the figures of the accompanying drawings and in which like reference numerals refer to similar elements and in which.

DESCRIPTION OF EXAMPLE POSSIBLE EMBODIMENTS

Figure 1:
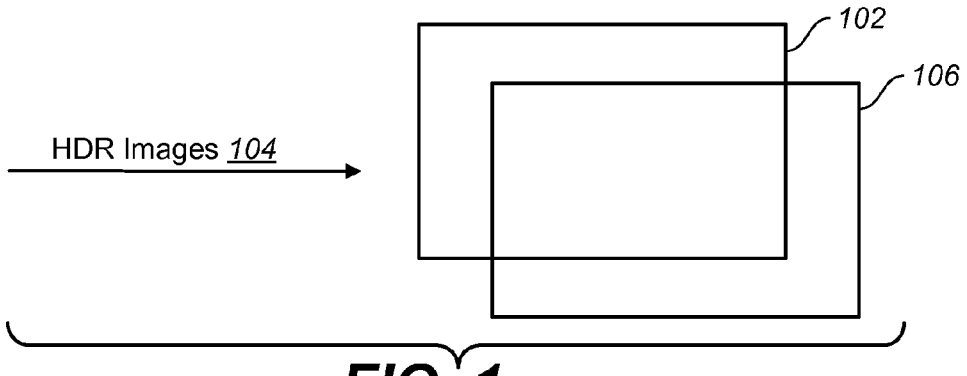
FIG. 1 depicts example high dynamic range (HDR) images rendered at full display backlight capacity.

Example possible embodiments, which relate to exploiting the full intensity reproduction capability of a display system, are described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily including, obscuring, or obfuscating the present invention.

Example embodiments are described herein according to the following outline:

1. GENERAL OVERVIEW
2. NORMALIZING BACKLIGHT
3. DISPLAY SYSTEMS
4. NORMALIZATION
5. EXAMPLE PROCESS FLOW
6. IMPLEMENTATION MECHANISMS—HARDWARE OVERVIEW
7. EQUIVALENTS, EXTENSIONS, ALTERNATIVES AND MISCELLANEOUS

1. General Overview

This overview presents a basic description of some aspects of a possible embodiment of the present invention. It should be noted that this overview is not an extensive or exhaustive summary of aspects of the possible embodiment. Moreover, it should be noted that this overview is not intended to be understood as identifying any particularly significant aspects or elements of the possible embodiment, nor as delineating any scope of the possible embodiment in particular, nor the invention in general. This overview merely presents some concepts that relate to the example possible embodiment in a condensed and simplified format, and should be understood as merely a conceptual prelude to a more detailed description of example possible embodiments that follows below.

Techniques for display backlight normalizations for a variety of images are described. In some possible embodiments, a display system may comprise a display panel. As used herein, the term display panel may refer to a display panel, a display unit or a display area on a cell phone, a PDA, a laptop, a display monitor, a TV, a photoframe, etc.

In some possible embodiments, drive values that determine light output levels of a plurality of light sources such as backlights may be derived based at least in part on (input) images. With high dynamic range (HDR) display systems, light sources therein may be configured to support a high dynamic range of luminous intensity for rendering images. If the low dynamic ranges as specified by low dynamic range (LDR) (input) images are used to render the LDR images, then drive values corresponding to an upper portion of the HDR range of which the display systems may be capable will not be reached when the LDR images are rendered.

Significantly, in practical applications of a display system, images to be rendered by the display system may specify different dynamic ranges of luminous intensity. For example, a first image may specify a first dynamic range while a second image may specify a second different dynamic range. In the meantime, a display system as described herein may be capable of rendering images with a maximum high dynamic range corresponding to the full intensity reproduction capability of the display system. In various possible embodiments, the maximum high dynamic range of the display system may be greater, wider, and/or deeper than all, or some, of the images that are to be rendered on the display panel. In some possible embodiments, a configured dynamic range of the display system may be set based on (e.g., set to) the maximum high dynamic range. In some other possible embodiments, a dynamic range control (which, for example, may be a user settable knob, possibly mechanically connected to an electronic or electro-mechanical control device, on a side of a photo frame device) may be provided by a display system as described herein. Through this dynamic range control, a user may set the configured dynamic range of the display system to a value at or below the maximum high dynamic range.

Instead of rendering images merely based on dynamic ranges of luminous intensity as specified by the images or the content therein, a display system as described herein may render images to the full extent of the configured dynamic range previously mentioned. To do so, a dynamic range of an image is first determined. The dynamic range may be used to determine a plurality of initial light output levels for a plurality of light sources in the display system. In some embodiments, the light output levels of the plurality of light sources are individually controllable. However, instead of driving the light sources directly with the plurality of initial light output levels as determined based on the dynamic range specified by the image, a display system as described herein may further compute a plurality of normalized light output levels for the plurality of light sources, based in part on the plurality of initial light output levels determined from the image, and use the plurality of normalized light output levels to drive the plurality of light sources in rendering the image.

In some possible embodiments, the plurality of initial light output levels may form a distribution over a range of initial light output levels. An upper limit and a lower limit may delimit the range of initial light output levels. A display system as described herein may determine a range of normalized light output levels. The range of normalized light output levels may be used to render images with the configured dynamic range of luminous intensity. A display system as described herein may map the range of initial light output levels to the range of light output levels. In some possible embodiments, an upper limit of the range of light output levels may be the overall maximum light output level to which a light source in the plurality of light sources can be set under the configured dynamic range, which may correspond to the full intensity reproduction capability of the display system, and optionally and/or alternatively, which may correspond to a user-configured capability less than the full intensity reproduction capability, as set by a user through the dynamic range control. It should be noted that in various possible embodiments, a linear mapping, a non-linear mapping (e.g., gamma compression/expansion), a table-driven mapping, or another suitable mapping, may be used to map the initial light out levels to the normalized light output levels.

As a result, instead of rendering an image with a dynamic range specified by the image, a display system as described herein renders the image with normalized light output levels, which result in rendering the image with a configured dynamic range of luminous intensity, which may, but is not limited, to the full intensity reproduction capability of the display system.

In some possible embodiments, the techniques as described above may be repeated for one, two or more subsequent images. For example, a second image with a second different dynamic range may still be rendered with the configured dynamic range of luminous intensity as the first image.

In some possible embodiments, normalizing a dynamic range specified by an image to the configured dynamic range of the display system may be independent of normalizing another dynamic range specified by another image to the configured dynamic range of the display system, regardless of whether these two images are next in time in the order of being rendered by the display system. In some possible embodiments, the display system as described herein may be a device that displays still images. Normalizing a dynamic range specified by one still image may be independent of normalizing another dynamic range specified by another still image, regardless of whether these two still images are next in time in the order of being rendered by the display system.

Techniques as described herein can be easily incorporated into high quality display systems, for example, HDR display systems with local dimming. Techniques as described herein may not only be used to correctly reproduce HDR images on a display system but also improve viewing experience with high dynamic range rendition of LDR images. Thus, techniques as described herein may be implemented to support rendering images across a wide spectrum of dynamic ranges.

In some possible embodiments, mechanisms as described herein form a part of a display system, including but not limited to a handheld device, game machine, television, laptop computer, netbook computer, cellular radiotelephone, electronic book reader, point of sale terminal, desktop computer, computer workstation, computer kiosk, and various other kinds of terminals and display units.

Various modifications to the preferred embodiments and the generic principles and features described herein will be readily apparent to those skilled in the art. Thus, the disclosure is not intended to be limited to the embodiments shown, but is to be accorded the widest scope consistent with the principles and features described herein.

2. Normalizing Backlight

FIG. 1 depicts example HDR images 104 rendered at full display backlight capacity. A display system may comprise a backlight unit 102 and a display panel 106. When the HDR images 104 are to be rendered, the display system may set the light output level of the backlight unit 102 in such a way that the HDR images are rendered with a high dynamic range corresponding to the full intensity reproduction capability of the display system.

Figure 2:
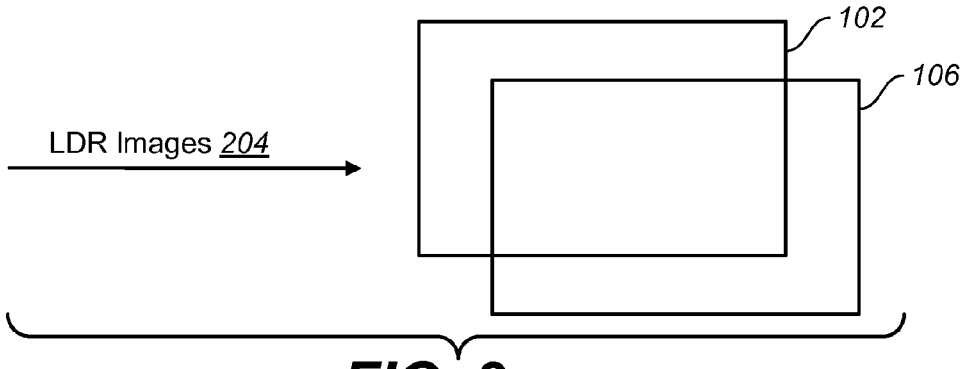
FIG. 2 depicts example low dynamic range (LDR) images rendered at a partial capacity of a backlight display.

FIG. 2 depicts example LDR images 204 rendered at a partial capacity of a backlight display. The display may not reach high luminance drive values in rendering the LDR images 204, which may limit the intensity range and color gamut of the rendered LDR images.

Figure 3:
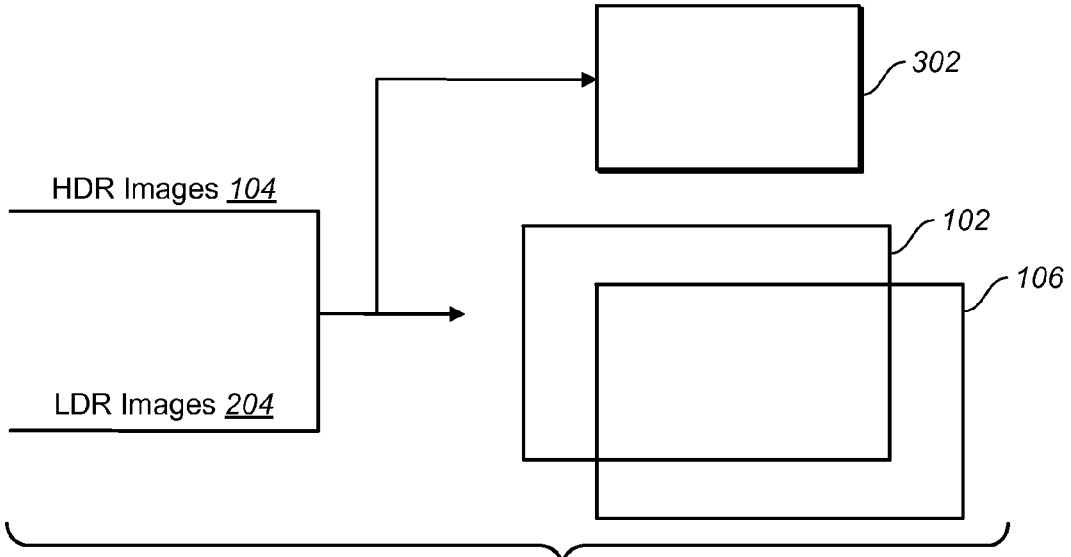
FIG. 3 depicts an example normalization of HDR and LDR images rendered at full display backlight capacity.

In some possible embodiments, a display system may use functions to normalize HDR and LDR images, in order to render HDR images and the LDR images at the full capability of the display system. FIG. 3 depicts an example normalization of HDR and LDR images (104 and 204), rendered at full display backlight capacity. As illustrated, images may be input to a backlight normalization unit, which may also be 302 of FIG. 3. The backlight normalization unit may drive the backlight to light output levels that correspond to the full capability of the display system. In some embodiments, the display system may provide a knob (such as the aforementioned knob) to allow a user to select a different dynamic range other than the dynamic range at the full capability of the display system.

3. Display Systems

Figure 4:
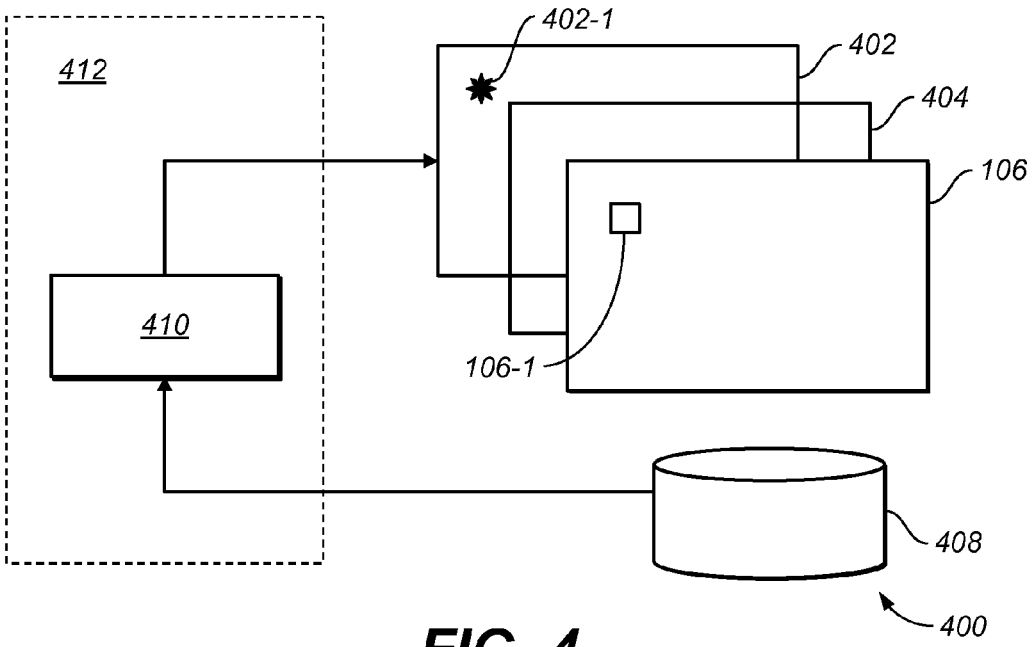
FIG. 4 illustrates an example display system.

FIG. 4 illustrates an example display system 400 in accordance with some possible embodiments of the present invention. In some possible embodiments, the display system 400 comprises a plurality of light sources 402, an optical stack 404 and a display panel 106.

In a possible embodiment, the display panel 106 may comprise a plurality of light valves. For example, the display panel 106 may be an LCD panel comprising a plurality of LCD pixels or sub-pixels as light valves. In some possible embodiments, a light valve as described herein may transmit light between a minimum transmittance and a maximum transmittance. For example, the minimum transmittance may be 0.1%, 0.4%, or a different percentile may be smaller or larger than the foregoing values, of the amount of backlight illuminated on the light valve. The maximum transmittance may be 4%, 10%, 20%, 40%, or a different percentile smaller or larger than the foregoing values, of the amount of backlight illuminated on the light valve. As described herein, the transmittance of a light valve may be individually set based on image data of an image that is to be rendered on the display panel 106.

As described herein, an optical stack (e.g., 404) may comprise one or more of optical, or electro-optical components such as diffusers, polarization layers, light-focusing layers (e.g., made of one or more light-redirecting optical prisms), reflective layers, substrate layers, thin films, retardation films, rubbing surfaces, light crystal layers, color and/or colorless filters, color enhancers, etc. For example, the optical stack 404 may comprise a diffuser such that backlight from the plurality of light sources 402, even though it may have a portion of light directed off axis relative to a z-axis (which is, e.g., a direction towards a viewer of the display system), may be redirected and evenly distributed by the diffuser into outgoing light that is substantially in the direction of the z-axis.

In some possible embodiments, some or all of the foregoing components in an optical stack may be disposed behind the plurality of light sources 402, between the plurality of light sources 402 and the display panel 106, in front of the display panel 106, or a combination thereof.

In some possible embodiments, to render an image, a display system may logically divide the display panel or the displayable area thereon into a plurality of display portions each of which may be illuminated by a different subset of light sources in the plurality of light sources. A display portion as described herein may comprise pixels or blocks of pixels whose luminance levels fall within a range of luminance levels that can be easily controlled by adjusting light output levels of light sources illuminating the display portion and by adjusting transmittances of light valves between the minimum transmittance and the maximum transmittance. The light valves may be configured to operate within this range from the minimum transmittance and the maximum transmittance. The transmittance of a light valve may be adjusted based on a pixel value that is to be loaded into a pixel.

Light output levels of light sources illuminating a display portion and the maximum transmittance of the light valves may be used to set a ceiling on the maximum luminance achievable on the display portion, while the same light output levels of the light sources illuminating the display portion and the minimum transmittance of the light valves may be used to set a floor on the minimum luminance.

The plurality of light sources 402 may, but are not limited to, be the same type of light sources. Each individual light source in the plurality of light sources 402 may be assigned to illuminate a different individual display portion on the display panel 106. A display portion on a display panel 106 may, but is not limited to, be of a particular geometric shape and/or size, which may or may not be the same as another display portion on the same display panel 106. For example, the plurality of light sources 402 may comprise an array of light emitting diodes (LEDs); a light source may comprise one or more LEDs.

As illustrated in FIG. 4, one or more light sources (e.g., 402-1) in the plurality of light sources 402 may be assigned to illuminate a display portion 106-1 on the display panel 106. Similarly, one or more different light sources (e.g., other than 402-1) in the plurality of light sources 402 may be assigned to illuminate a different display portion other than 106-1 on the display panel 106. As used herein, a display portion on the display panel 106 may comprise one or more pixels or light valves; such a display portion may, additionally and/or optionally, comprise one or more color filters that cover the pixels or light valves.

In some possible embodiments, the light output level of a light source as described herein may be controlled individually or together with light output levels for one or more other light sources in the plurality of light sources 402. For example, a light source (e.g., 402-1) may be set as in one of one or more "on" states (e.g., fully on, partially on at one of 2, 4, 8, 16, 32, 64, 128, 256 or more levels, etc.), while a different light source in the plurality of light sources 402 may be set in an "off" state, or a same or different "on" state.

In some possible embodiments, the display system 400 may comprise, or may be configured to receive image data for one or more images from an image source 408.

In some possible embodiments, the display system 400 may comprise a light source controller 412 to monitor and control the states of each light source in the plurality of light sources. In some possible embodiments, the light source controller 412 may comprise a display backlight normalization unit 410 that is configured to receive image data from the image source 408. The display backlight normalization unit 410 may be configured to process the image data from the image source 408 to determine a dynamic range specified by an image in the image data. The light source controller 412 or the display backlight normalization unit 410 therein, may determine a plurality of initial light output levels that are required to render the image with the specified dynamic range.

In some possible embodiments, the display system 400, or the light source controller 412 therein, may establish or determine a configured dynamic range of luminous intensity that is currently in effect. For example, this configured dynamic range may correspond to the maximum dynamic range as given by the full intensity reproduction capability of the display system 400. Additionally and/or optionally, the configured dynamic range may correspond to a user selected dynamic range, for example, through a dynamic range control (such as the aforementioned knob) on the display system.

In some possible embodiments, the display system 400, or the light source controller 412 therein, may establish or determine a range of normalized light output levels that is required to support the configured dynamic range of luminous intensity that is currently in effect. For example, this range of normalized light output levels may comprise an upper limit that corresponds to the maximum light output level to which a light source in the display system 400 can be set. Additionally and/or optionally, the upper limit of the range of normalized light output levels may correspond to a light output level that be less than the maximum light output level to which a light source in the display system 400 can be set, but rather correspond to a light output level to produce an upper limit of a user selected dynamic range set, for example, through a dynamic range control (such as the aforementioned knob) on the display system.

In some possible embodiments, it may be that the determination of a range of normalized light output levels occurs before the determination of a configured dynamic range of luminous intensity in reproducing images on the display system.

In some possible embodiments, the determination of a range of normalized light output levels and/or the determination of a configured dynamic range of luminous intensity may not performed for each image but rather may only be performed by the display system upon the device boot ups and restarts, at the time when a user makes an input, periodically, on-demand, upon the firing of a timer, after a set period of little activity, etc. In some possible embodiments, these determinations may be made whenever one, two, or more images have been displayed.

As used herein, the term "luminous intensity" may refer to a photometric intensity, a luminance level, a brightness level, a weighted sum of intensity values, a weighted sum of gamma-corrected values, a luma value, etc.

As used herein, the term "independent" means that the normalization of one dynamic range of one image does not influence the normalization of another dynamic range of another image. As used herein, the term "light output level" may refer to a drive value to drive a particular light source to a particular intensity corresponding to the light output level; in some embodiments, the drive value may represent an amount of electric current that is to be driven through the light source in order to obtain the particular intensity.

As used herein, the term "HDR" may, but is not limited to, relate to a dynamic range that essentially spans the perceptual capability of the human visual system (HVS). As used herein, the term "LDR" may, but is not limited to, relate to a DR that may be associated with the image intensity rendering capability of a typical cathode ray tube (CRT) display or liquid crystal display (LCD) unit, either of which may be used in television (TV), computer monitors, or electronic image display frames that has a constant (e.g., non-separately modulated) back light unit (BLU).

4. Normalization

Under techniques as described herein, a drive value for a light source may be raised based on a computation (e.g., a normalization mapping) that may change an initial light output level as specified by an image to a greater, or the maximum, drive value supported with a display unit. This allows the full range of drive values to be used to display both HDR and LDR images. In some possible embodiments, normalization functions operate to stretch histograms formed by initial light output levels, thereby enhancing image contrast when the image is rendered by the display system 400 on the display panel 106. In some other possible embodiments, however, the normalization functions or curves may be selected according to a different process than for stretching histograms.

Figure 5A:
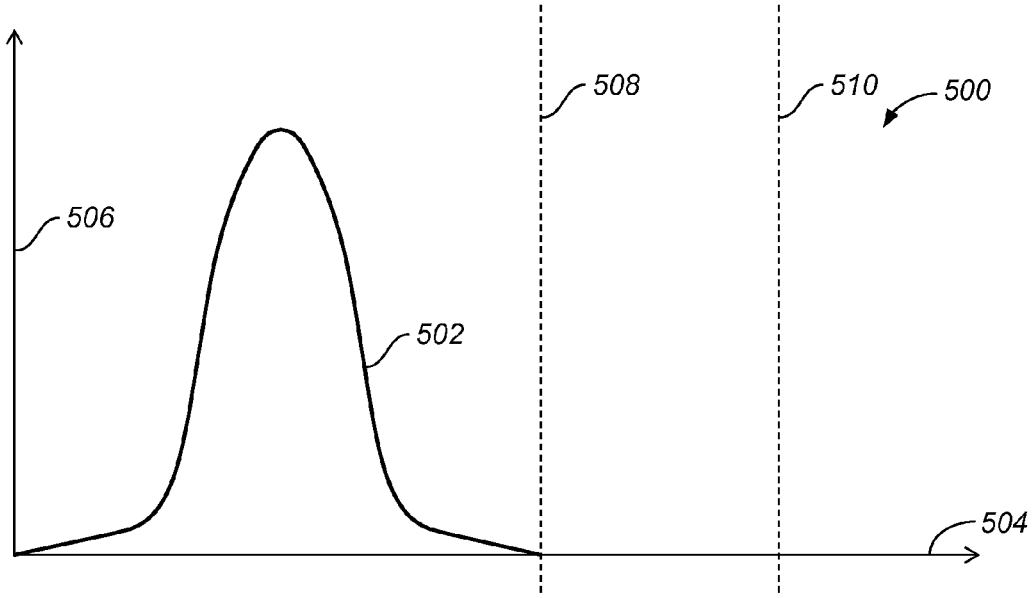
FIG. 5A and FIG. 5B illustrate example distributions of light output levels.

FIG. 5A illustrates an example initial light output distribution 502 for a plurality of initial light output levels as described herein in accordance with a possible embodiment of the present invention. In some possible embodiments, a histogram chart 500 may comprise a first axis 506 representing count-of-light-sources values and a second axis 504 representing light output level values. In some possible embodiments, the initial light output distribution 502 may be represented as count-of-light-sources histogram in a histogram chart 500 for the plurality of initial light output levels. As illustrated, the initial light output distribution 502 may take up non-zero data points (e.g., non-zero counts-of-light-sources) over a range of initial light output levels (or values) as specified by an image that is to be rendered by a display system as described herein. Integrating the initial light output distribution 502 over the range of initial light output levels may give rise to a total number of light sources in the display system 400. An upper limit 508 of the range of initial light output levels may be lower than an upper limit 510 of a range of normalized light output levels as described herein. Thus, driving the light sources using the plurality of initial light output levels as indicated by the initial light output distribution 502 would fail to realize the greater or full potential of the intensity reproduction capability of which the display system 400 is in possession. It should be noted that while the initial light output distribution 502 is depicted as a continuous function in FIG. 5A (and in FIG. 5B), in some possible embodiments, a distribution as described herein may be represented as a set of discrete valued data points, a pie chart, a different graphic representation, etc.

Figure 5B:
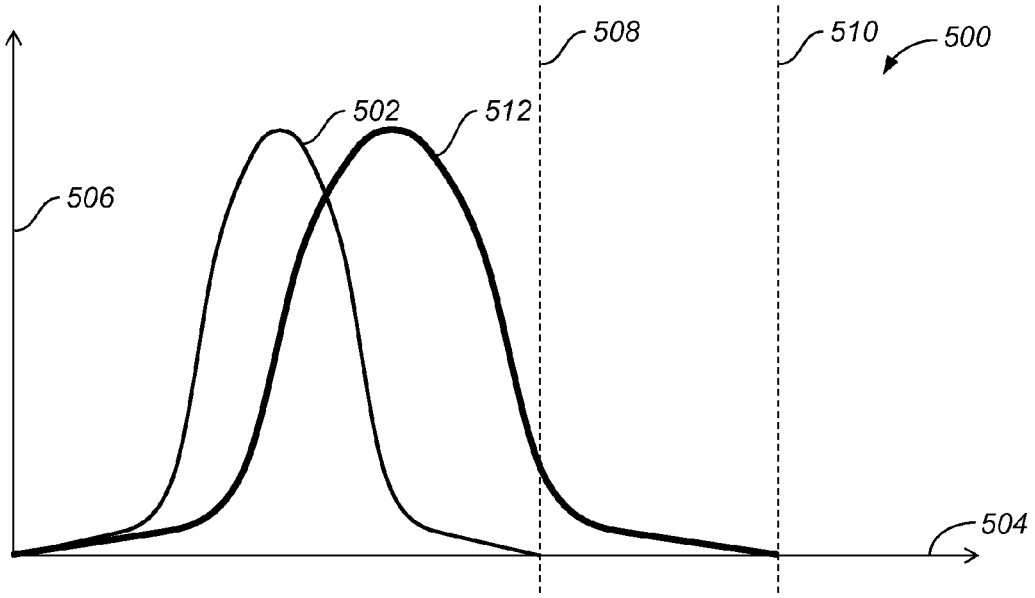

FIG. 5B illustrates an example normalized light output distribution 512 derived/transformed using a normalization mapping that maps an initial light out distribution (e.g., 502) to the normalized light output distribution 512 in accordance with a possible embodiment of the present invention. In some possible embodiments, the normalization mapping may be a (normalization) function, analytic or non-analytic. In some possible embodiments, additionally and/or optionally, the normalization mapping may be table-driven. In some possible embodiments, additionally and/or optionally, the normalization mapping may be gamma compressions or expansions. In one of these possible embodiments mentioned above, the normalization mapping may simply be implemented with a (normalization) ratio of the upper limit of the range of normalized light output levels to the upper limit of the range of initial light output levels. In such an embodiment, an initial light output level in the plurality of initial light output levels may be scaled to a normalized light output level by multiplying the initial light output level with the normalization ratio. It should be noted that other variations of normalization approaches may also be used for the purpose of the present invention. For example, instead of directly mapping an initial light output level to a normalized light output level, the initial light output level may be first normalized to a standard value, for example, within a standard range such as a range between zero (0) and one (1); subsequently, the standard value may be scaled to an actual light output level that is to be used to drive a corresponding light source in the display system 400. In some possible embodiments, the normalized light output distribution 512 mapped from the initial light output distribution 502 may comprise the same upper limit as that of the range of normalized light output levels that correspond to the configured dynamic range of luminous intensity in rendering images.

5. Example Process Flow

Figure 6:
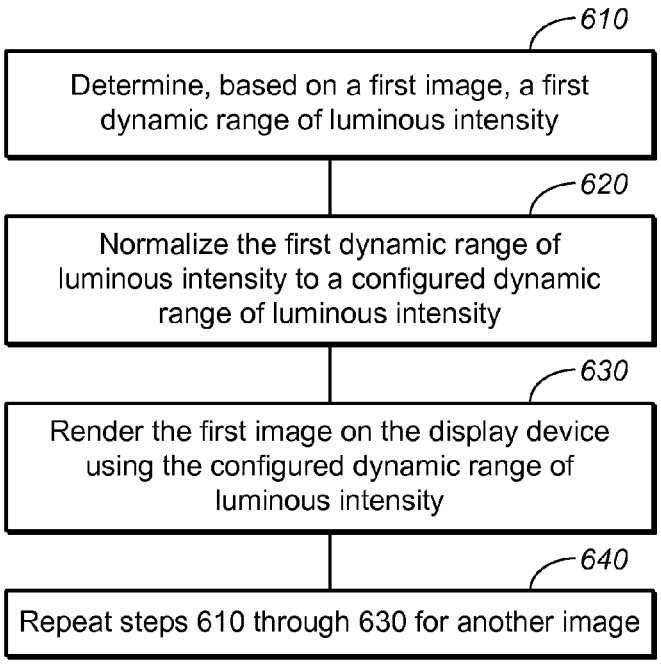
FIG. 6 illustrates example process flows.

FIG. 6 illustrates an example process flow according to a possible embodiment. In some possible embodiments, one or more computing devices or components in a display system may perform this process flow.

In block 610, a display system (e.g., 400) determines, based on a first image, a first dynamic range of luminous intensity. The first dynamic range may be specified by the first image.

In block 620, the display system 400 normalizes the first dynamic range of luminous intensity to a configured dynamic range of luminous intensity. The configured dynamic range being supported by the display system 400. In some possible embodiments, the configured dynamic range may be an HDR. In some possible embodiments, the configured dynamic range may be supported by a plurality of light sources, and wherein each individual light source in the plurality of light sources is individually settable to an individual light output level.

In block 630, the display system 400 renders the first image on the display system using the configured dynamic range of luminous intensity. As used herein, the phrase "renders the first image" may refer to first transforming the first image to another image, which may be transient (without being saved following displaying), and then displaying the other image instead of the first image.

In block 640, the foregoing steps in blocks 610-630 may be repeated for one, two, or more images, which may be, but are not limited to, subsequent images. For example, the display system 400 may determine, based on a second image, a second dynamic range of luminous intensity. The second dynamic range may be specified by the second image and differs from the first dynamic range. The display system 400 may normalize the second dynamic range of luminous intensity to the configured dynamic range of luminous intensity. The display system 400 may render the second image on the display system using the configured dynamic range of luminous intensity. The second image may be an image to be rendered by the display system next in time to the first image. In some possible embodiments, the normalization of the second dynamic range is not influenced by the normalization of the first image.

In a possible embodiment, at least one of the first dynamic range and the second dynamic range is smaller than the configured dynamic range.

In a possible embodiment, the configured dynamic range corresponds to the full intensity reproduction capability of the display system.

In a possible embodiment, at least one of the first image and the second image is a high dynamic range (HDR) image. In another possible embodiment, at least one of the first image and the second image is a low dynamic range (LDR) image.

In some possible embodiments, normalizing the first dynamic range of luminous intensity to a configured dynamic range of luminous intensity may include mapping a first upper limit of the first dynamic range to an upper limit of the configured dynamic range. In a possible embodiment, mapping the first upper limit to an upper limit of the configured dynamic range may be performed with a function. In various possible embodiments, the function may be a linear function (e.g., a linear scaling with a ratio as determined by two upper limits of different dynamic ranges), a non-linear function, an analytical function, a non-analytical function.

In some possible embodiments, the display system 400 may be designed for displaying still images. In some possible embodiments, at least one of the first image and the second image is a still image.

In some possible embodiments, a display system as described herein may provide a dynamic range control to a user; the dynamic range control enables the user to select the configured dynamic range from at least two configurable dynamic ranges as supported by the display system.

In some possible embodiments, a method for normalizing dynamic ranges of images may comprise: normalizing either image of a pair of images, wherein a first of the image pair has a first dynamic range and the second of the image pair has a second dynamic range; wherein the first dynamic range is wider, greater or deeper than the second dynamic range; and rendering either image of the image pair wherein either image of the image pair is rendered with the full intensity reproduction capability of a display with which the images are rendered.

6. Implementation Mechanisms—Hardware Overview

According to one embodiment, the techniques described herein are implemented by one or more special-purpose computing devices. The special-purpose computing devices may be hard-wired to perform the techniques, or may include digital electronic devices such as one or more application-specific integrated circuits (ASICs) or field programmable gate arrays (FPGAs) that are persistently programmed to perform the techniques, or may include one or more general purpose hardware processors programmed to perform the techniques pursuant to program instructions in firmware, memory, other storage, or a combination. Such special-purpose computing devices may also combine custom hard-wired logic, ASICs, or FPGAs with custom programming to accomplish the techniques. The special-purpose computing devices may be desktop computer systems, portable computer systems, handheld devices, networking devices or any other device that incorporates hard-wired and/or program logic to implement the techniques.

Figure 7:
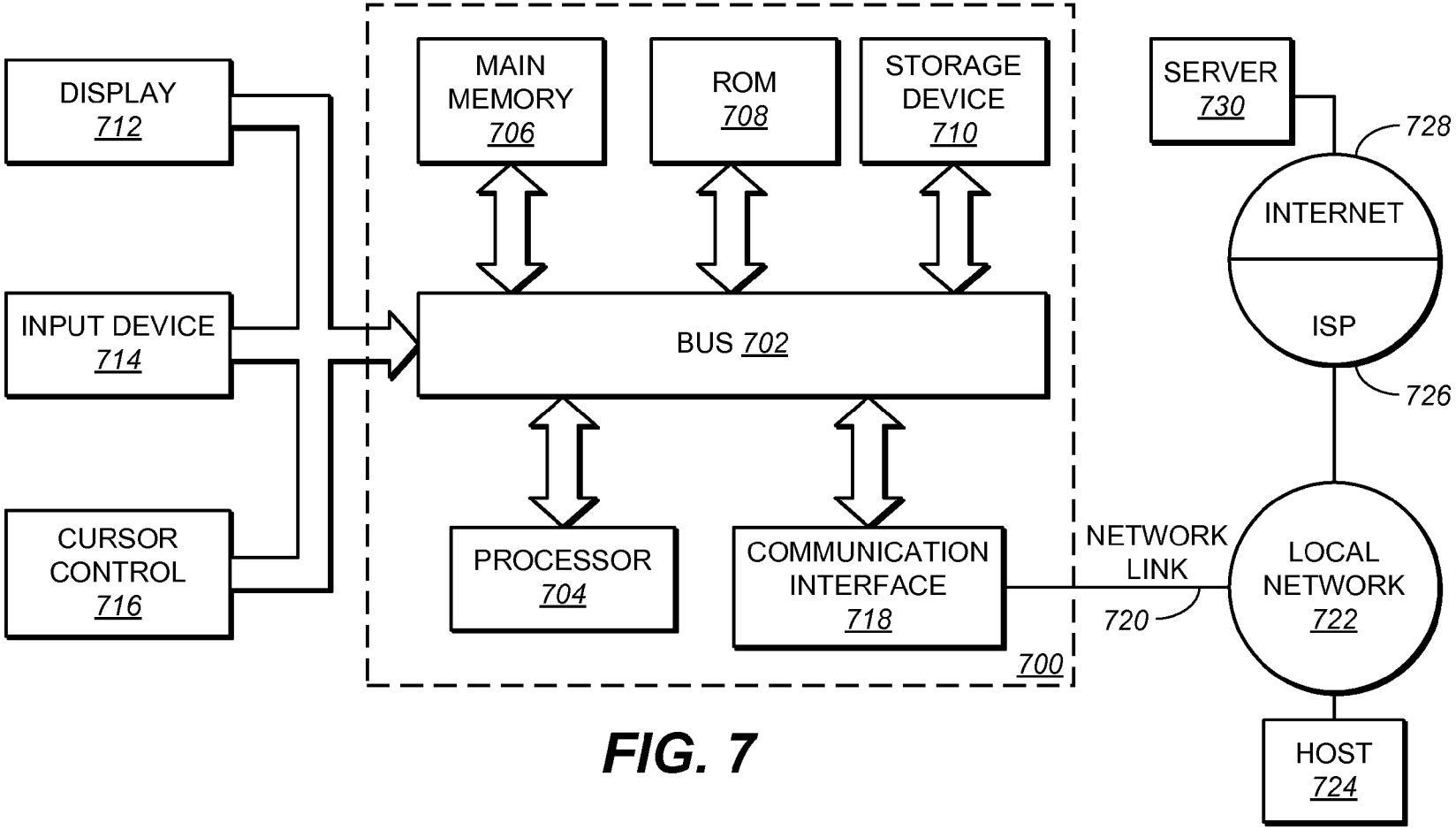
FIG. 7 illustrates an example hardware platform on which a computer or a computing device as described herein may be implemented, according a possible embodiment of the present invention.

For example, FIG. 7 is a block diagram that illustrates a computer system 700 upon which an embodiment of the invention may be implemented. Computer system 700 includes a bus 702 or other communication mechanism for communicating information, and a hardware processor 704 coupled with bus 702 for processing information. Hardware processor 704 may be, for example, a general purpose microprocessor.

Computer system 700 also includes a main memory 706, such as a random access memory (RAM) or other dynamic storage device, coupled to bus 702 for storing information and instructions to be executed by processor 704. Main memory 706 also may be used for storing temporary variables or other intermediate information during execution of instructions to be executed by processor 704. Such instructions, when stored in storage media accessible to processor 704, render computer system 700 into a special-purpose machine that is customized to perform the operations specified in the instructions.

Computer system 700 further includes a read only memory (ROM) 708 or other static storage device coupled to bus 702 for storing static information and instructions for processor 704. A storage device 710, such as a magnetic disk or optical disk, is provided and coupled to bus 702 for storing information and instructions.

Computer system 700 may be coupled via bus 702 to a display 712 for displaying information to a computer user. An input device 714, including alphanumeric and other keys, is coupled to bus 702 for communicating information and command selections to processor 704. Another type of user input device is cursor control 716, such as a mouse, a trackball, or cursor direction keys for communicating direction information and command selections to processor 704 and for controlling cursor movement on display 712. This input device typically has two degrees of freedom in two axes, a first axis (e.g., x) and a second axis (e.g., y), that allows the device to specify positions in a plane. Computer system 700 may be used to control the display system (e.g., 400 in FIG. 4). In some possible embodiments, display 712 is the same as display system 400. In some other embodiments, display 712 may be a separate display to the display system 400.

Computer system 700 may implement the techniques described herein using customized hard-wired logic, one or more ASICs or FPGAs, firmware and/or program logic which in combination with the computer system causes or programs computer system 700 to be a special-purpose machine. According to one embodiment, the techniques herein are performed by computer system 700 in response to processor 704 executing one or more sequences of one or more instructions contained in main memory 706. Such instructions may be read into main memory 706 from another storage medium, such as storage device 710. Execution of the sequences of instructions contained in main memory 706 causes processor 704 to perform the process steps described herein. In alternative embodiments, hard-wired circuitry may be used in place of or in combination with software instructions.

The term "storage media" as used herein refers to any media that store data and/or instructions that cause a machine to operation in a specific fashion. Such storage media may comprise non-volatile media and/or volatile media. Non-volatile media includes, for example, optical or magnetic disks, such as storage device 710. Volatile media includes dynamic memory, such as main memory 706. Common forms of storage media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge.

Storage media is distinct from but may be used in conjunction with transmission media. Transmission media participates in transferring information between storage media. For example, transmission media includes coaxial cables, copper wire and fiber optics, including the wires that comprise bus 702. Transmission media can also take the form of acoustic or light waves, such as those generated during radio-wave and infra-red data communications.

Various forms of media may be involved in carrying one or more sequences of one or more instructions to processor 704 for execution. For example, the instructions may initially be carried on a magnetic disk or solid state drive of a remote computer. The remote computer can load the instructions into its dynamic memory and send the instructions over a telephone line using a modem. A modem local to computer system 700 can receive the data on the telephone line and use an infra-red transmitter to convert the data to an infra-red signal. An infra-red detector can receive the data carried in the infra-red signal and appropriate circuitry can place the data on bus 702. Bus 702 carries the data to main memory 706, from which processor 704 retrieves and executes the instructions. The instructions received by main memory 706 may optionally be stored on storage device 710 either before or after execution by processor 704.

Computer system 700 also includes a communication interface 718 coupled to bus 702. Communication interface 718 provides a two-way data communication coupling to a network link 720 that is connected to a local network 722. For example, communication interface 718 may be an integrated services digital network (ISDN) card, cable modem, satellite modem, or a modem to provide a data communication connection to a corresponding type of telephone line. As another example, communication interface 718 may be a local area network (LAN) card to provide a data communication connection to a compatible LAN. Wireless links may also be implemented. In any such implementation, communication interface 718 sends and receives electrical, electromagnetic or optical signals that carry digital data streams representing various types of information.

Network link 720 typically provides data communication through one or more networks to other data devices. For example, network link 720 may provide a connection through local network 722 to a host computer 724 or to data equipment operated by an Internet Service Provider (ISP) 726. ISP 726 in turn provides data communication services through the world wide packet data communication network now commonly referred to as the "Internet" 728. Local network 722 and Internet 728 both use electrical, electromagnetic or optical signals that carry digital data streams. The signals through the various networks and the signals on network link 720 and through communication interface 718, which carry the digital data to and from computer system 700, are example forms of transmission media. Computer system 700 can send messages and receive data, including program code, through the network(s), network link 720 and communication interface 718. In the Internet example, a server 730 might transmit a requested code for an application program through Internet 728, ISP 726, local network 722 and communication interface 718. The received code may be executed by processor 704 as it is received, and/or stored in storage device 710, or other non-volatile storage for later execution.

7. Equivalents, Extensions, Alternatives and Miscellaneous

In the foregoing specification, possible embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method for rendering images on a high dynamic range display system comprising:

receiving a first image;

determining, based on the first image, a first dynamic range of luminous intensity;

normalizing the first dynamic range of luminous intensity to a first configured dynamic range of luminous intensity;

rendering the first image on the display system using the configured dynamic range of luminous intensity;

outputting first image on the display system;

receiving a second image, wherein the second image is different from the first image;

determining, based on a second different image, a second dynamic range of luminous intensity, the second dynamic range being determined from the second image and differing from the first dynamic range;

wherein the first dynamic range represents a wider dynamic range than the second dynamic range;

normalizing the second dynamic range of luminous intensity to the second configured dynamic range of luminous intensity the first configured dynamic range is less than the second configured dynamic range; and rendering the second image on the display system using the second configured dynamic range of luminous intensity;

outputting second image on the display system;

wherein at least one of the first image and the second image comprises a low dynamic range (LDR) image, one of the first and second configured dynamic range comprises a high dynamic range (HDR), and at least one of the first dynamic range and the second dynamic range is smaller than one of the first and second configured dynamic range;

wherein the steps of rendering the images comprises rendering the images on a locally dimmed display and normalizing the backlights of the display to a range of values having an upper limit that is less than the maximum light output level to which a backlight can be set but which comprises a light output level to produce an upper limit of a dynamic range selected for display of the images; and wherein the display system further comprises a dynamic range control to a user; the dynamic range control configured to accept a selection by the user of a configured dynamic range from at least two configurable dynamic ranges as supported by the display system.

2. The method of claim 1, wherein one of the first and second configured dynamic range corresponds to the full luminous intensity reproduction capability of the display system.

3. The method of claim 1, wherein the second image comprises an image to be rendered by the display system next in time to the first image.

4. The method of claim 1, wherein the normalization of the second dynamic range is independent of an influence by the normalization of the first image.

5. The method of claim 1, wherein at least one of the first image and the second image comprises a high dynamic range (HDR) image.

6. The method of claim 1, wherein one of the first and second configured dynamic range is produced at least in part by a plurality of light sources, and wherein each individual light source in the plurality of light sources is individually settable to an individual light output level.

7. The method of claim 1, wherein normalizing the first dynamic range of luminous intensity to a configured dynamic range of luminous intensity includes mapping a first upper limit of the first dynamic range to an upper limit of the configured dynamic range.

8. The method of claim 7, wherein mapping the first upper limit to an upper limit of the configured dynamic range is performed based on a normalization function.

9. The method of claim 8, wherein the normalization function comprises a linear function.

10. The method of claim 8, wherein the normalization function comprises a non-linear function.

11. The method of claim 1, wherein at least one of the first image and the second image comprises a still image.

12. A method for rendering images on a high dynamic range display system comprising:

receiving a pair of images, wherein the second image of the image pair is different from the first image of the image pair;

normalizing dynamic ranges of a pair of images respectively to a first and a second configured dynamic range respectively, wherein a first image of the image pair has a first dynamic range and the second image of the image pair has a second dynamic range, and wherein the first configured dynamic range and the second configured dynamic range configured to be selectable by a user and wherein the first configured dynamic range is less than the second configured dynamic range;

wherein the first dynamic range is wider, greater, or deeper than the second dynamic range; and rendering each image of the image pair with the first and the second configured dynamic range respectively;

outputting the first image and the second images on the display system;

wherein the step of rendering each image comprises rendering the images on a locally dimmed display and normalizing the backlights of the display to a range of values having an upper limit that is less than the maximum light output level to which a backlight can be set but which comprises a light output level sufficient to produce an upper limit of a dynamic range selected for display of the images; and wherein the display system further comprises a dynamic range control to a user; the dynamic range control configured to accept a selection by the user of a configured dynamic range from at least two configurable dynamic ranges as supported by the display system.

13. A display system configured to perform the method recited in claim 1.

14. An apparatus comprising a processor and configured to perform the method recited in claim 12.

15. A non-transitory computer readable storage medium, comprising software instructions, which when executed by one or more processors cause performance of the method recited in claim 1.

* * * * *